United States Patent [19]

McMullen et al.

[11] Patent Number: 4,585,530

[45] Date of Patent: Apr. 29, 1986

[54] PROCESS FOR FORMING ADHERENT CHROMIUM ELECTRODEPOSITS FROM HIGH ENERGY EFFICIENT BATH ON FERROUS METAL SUBSTRATES

[75] Inventors: Warren H. McMullen, East Brunswick; Hyman Chessin, Brick; Allen R. Jones, Belford, all of N.J.

[73] Assignee: M&T Chemicals Inc., Woodbridge, N.J.

[21] Appl. No.: 764,273

[22] Filed: Aug. 9, 1985

[51] Int. Cl.[4] ..... C25D 5/36

[52] U.S. Cl. ..... 204/34; 204/32.1; 204/51

[58] Field of Search ..... 204/32.1, 34, 51

[56] References Cited

U.S. PATENT DOCUMENTS

| | | | |
|---|---|---|---|
| 4,093,522 | 6/1978 | Dillenberg | 204/51 |
| 4,234,396 | 11/1980 | Perakh et al. | 204/51 |
| 4,412,892 | 11/1983 | Chen et al. | 204/34 |
| 4,450,050 | 5/1984 | Chessin et al. | 204/41 |
| 4,472,249 | 9/1984 | Chessin | 204/51 |
| 4,507,178 | 3/1985 | Barclay et al. | 204/29 |

FOREIGN PATENT DOCUMENTS

| | | | |
|---|---|---|---|
| 1903580 | 8/1969 | Fed. Rep. of Germany | 204/32.1 |

*Primary Examiner*—G. L. Kaplan

*Attorney, Agent, or Firm*—S. H. Parker; J. Mataon; R. E. Bright

[57] ABSTRACT

An improved activation solution is provided for forming adherent chromium electrodeposits on metal substrates from high energy efficient chromium baths. The solution is a substantially neutral alkali metal sulfate solution.

13 Claims, No Drawings

PROCESS FOR FORMING ADHERENT CHROMIUM ELECTRODEPOSITS FROM HIGH ENERGY EFFICIENT BATH ON FERROUS METAL SUBSTRATES

BACKGROUND OF THE INVENTION

1. Field of the Invention

This invention relates to electrodeposition of chromium on basis metals, and, more particularly, it is concerned with an activation process by which an adherent chromium electrodeposit is formed on ferrous metal substrates using a high energy efficient chromium plating bath.

2. Description of the Prior Art

The use of high efficiency chromium plating processes has been hampered by the inability to obtain adequate coating adhesion to certain basis metals.

Chromium plating baths containing halides have exhibited adhesion problems. Such baths are of the types disclosed in Mitsui, J7B-33941 (September, 1978); Dillenberg U.S. Pat. No. 4,093,522; Perakh et al., U.S. Pat. No. 4,234,396; and Chessin, U.S. Pat. Nos. 4,450,050 and 4,472,249.

The problem has been attributed to the presence of a halide which may interfere at the initiation of deposition.

In order to obtain an adequate bond as measured by ASTM B 571-79, with typical chromium plating solutions, such as those using a solution of chromic acid and catalysts such as sulfate or sulfate in combination with various fluorides, the usual technique is to reverse or anodically etch a ferrous workpiece in the plating solution or in a separate chromium acid containing solution at a predetermined current density for a predetermined time.

A table which lists the time lengths for such an etching process is found in "Metal Finishing" 80 (5) 65-8 (1982) by C. H. Peger. The use of certain sulfuric acid and hydrofluoric acid etches for specific stainless steels is also suggested in the publication.

Anodic chromic acid treatments for 400 stainless steel alloys and for low and high carbon steels is disclosed in "48th Metal Finishing Guidebook-Directory" 78, 188–202 (1980) by A. Logozzo. Also recommended are cathodic treatments in sulfuric-fluoride solutions for 300 stainless, for nickel alloys and for cast iron.

A further alternative which is found in the prior art is the use of a Woods nickel strike for certain special nickel and cobalt-based alloys. (Boeing Aircraft) BAC5709-5.2j(1).

The use of a ferric chloride-hydrochloric acid solution as a clearing agent for the smut produced by anodic sulfuric etches is disclosed at page 137 of "Hard Chromium Plating" Robert Draper Ltd., Teddington, 1964 by J. D. Greenwood.

Brune and McEnally in "Plating"42, 1127–32 (1955) describe the use of a magnesium sulfate sulfuric acid anodic etch solution for preparing ferrous parts for plating. Similarly, ASTM Specification B-242-49T suggests the application of an anodic etch using a sulfuric acid solution containing sodium sulfate. ASTM B177-68 described the use of sulfuric acid or chromic acid as activators for chromium electroplating on steel for engineering use.

Chessin in U.S. Pat. No. 4,450,050 described an activation pretreatment for bonding high efficiency chromium electrodeposits on a metal substrate which is characterized by the step of first plating the substrate metal with iron or an iron alloy from an iron salt containing bath.

Hermann, in U.S. Pat. No. 4,416,758, activates metal substrates in an aqueous alkaline cyanide containing solution using current which is periodically reversed, followed by rinsing and chromium plating.

It has been found that when these procedures are employed with the halide containing chromium plating baths, most of the ferrous metal substrates are not adequately plated in that the chromium deposits from these baths have inadequate adhesion.

It can be speculated that the reducing conditions at the cathode at the initiation of deposition cause the halide ion to be reduced to a form which interferes with the molecular bonding of the chromium to the substrate. In any event the use of high efficiency chromium plating is limited by the problem of inadequate adhesion.

Accordingly, it is an object of this invention to provide an improved process for forming adherent chromium electrodeposits, particularly from high energy efficient baths, on ferrous metal substrates.

Another object herein is to provide an activation solution for pretreating a ferrous metal substrate before electrodepositing chromium thereon, which solution does not require the use of strong acids such as sulfuric acid, which would effect the ferrous metal substrates.

Still another object is to provide an activation solution for electrolytically, preferably anodically, etching a ferrous metal substrate in preparation for electrodepositing an adherent chromium metal deposit thereon from a high energy efficient bath, where the degree of adherence of the chromium deposit is relatively independent of the transit time between activation and rinsing.

Yet another object herein is to provide adherent and smooth chromium deposits on a ferrous metal substrate from a high energy efficient chromium electroplating bath.

SUMMARY OF THE INVENTION

It has now been found that the adherence problems encountered with the prior art systems for electrodepositing chromium on metal substrates from high energy baths can be overcome through the use of a process in which a metal substrate is subjected to an activation step in an activation solution which is a substantially neutral (pH 5–10) alkali metal sulfate solution. The activation solution does not require sulfuric or chromic acids to perform its activating function.

In accordance with the present invention an adherent and smooth chromium electrodeposit is obtained on a metal substrate by means of a process which comprises the steps of electrolytically etching the metal substrate in said activation solution, and thereafter electrodepositing chromium metal thereon.

The process herein is particularly useful in that it is capable of forming adherent chromium electrodeposits from a high energy efficient chromium plating bath, that is, one which includes a halide ion therein. As an additional feature of the invention, the degree of adherence is substantially independent of the transit period between activation and rinsing the metal substrate, in advance of the actual electroplating of chromium thereon.

DETAILED DESCRIPTION OF THE INVENTION

While the process of the invention can be utilized for electrodepositing chromium from any chromium bath, it can be used advantageously for forming adherent chromium on a metal substrate from a high energy efficient chromium bath which includes a halide ion as an essential constituent. The presence of the halide ion can cause problems with adherence of the chromium deposit unless the metal substrate is given the pretreatment of the invention. Such high energy efficient baths are described in Chessin, U.S. Pat. No. 4,472,249. A prior art less advantageous pretreatment for bonding such high efficiency chromium electrodeposits is described in Chessin et al., U.S. Pat. No. 4,450,050.

The process of the present invention comprises subjecting the metal substrate to electrolytic, preferably anodic, etching in a substantially neutral (pH 5–10) solution of an alkali metal sulfate, and electrodepositing chromium thereon.

The electrolytic etching step is carried out for about 10 seconds to 10 minutes at a current density of about 0.1 asi to 10 asi, and at a temperature from about room temperature to 50° C.

After the activation step the current is turned off and the activated metal substrate is transferred to a rinsing vessel where it is rinsed free of the activation solution. Then the metal substrate is placed in the chromium electroplating bath and chromium metal is deposited thereon.

Optionally, a reverse (i.e. the workpiece is made the anode) in a chromic acid-containing solution, for example, the chromium plating solution itself, may be used preceding the actual chromium plating operation.

The activation solution, while free of added sulfuric acid or chromic acid, may contain one or more of the following additives: a buffer, such as borax, to maintain the pH of the solution at the desired level; an oxidizing salt, such as sodium molybdate or sodium chromate, for faster polarization; an attack metal compound, such as sodium chloride or sodium nitrate, to aid in attacking the surface of the substrate; a complexor such as citrate or gluconate, to stabilize the products of the electrolytic reaction; and a surfactant to reduce surface tension between solution and substrate.

Typical metal substrates include ferrous metals such as cast irons and alloy and high carbon steels.

The invention will now be described with reference to the following examples, which are not to be construed as limiting of the invention.

EXAMPLE 1

An activation solution was prepared from 45 g/l of sodium sulfate and 20 g/l of sodium molybdate hexahydrate. The pH was 7. A cast iron substrate was placed in the solution at room temperature and the substrate was anodically etched at 0.5 asi for 30 seconds. After transfer to a rinsing bath, the activated metal was chromium plated in a high energy efficient bath containing iodide ion at 5 asi for 60 minutes. The chromium deposit exhibited excellent adherence to the substrate and was smooth.

A similar process in the absence of application of any reverse activation current provided only very poor adhesion of chromium on the cast iron metal substrate.

EXAMPLE 2

The activation solution consisted of 120 g/l sodium sulfate and 40 g/l of sodium nitrate. The pH was 6. The substrate was strut steel, 1024, an induction hardened steel. Activation was carried out at 23° C. at 1 asi for 3 minutes, followed by rinsing and high energy chromium reverse at 5 asi for 3 minutes, and high energy chromium plating at 5 asi for 15 minutes. The adherence of the chromium to the substrate was excellent and the deposit was quite smooth.

EXAMPLE 3

The process of Example 2 was repeated using additionally 10 g/l of boric acid in the activation solution, a pH of 7, and anodic etching at 2 asi for 2 minutes. A similar excellent adhering deposit was obtained.

EXAMPLE 4

The process of Example 2 was repeated using an activation solution comprising 40 g/l sodium sulfate, 20 g/l sodium nitrate, 20 g/l sodium citrate dihydride, 5 g/l sodium chloride, and 20 g/l sodium tetraborate hexahydrate. The pH was 8. Activation was carried out at 1 asi for 4 minutes, reverse etching in a high energy bath at 5 asi for 3 minutes and chromium plating at 5 asi for 15 minutes. An adherent, smooth chromium deposit was obtained.

EXAMPLE 5

The process of the above examples was repeated using potassium sulfate in place of sodium sulfate with similar advantageous results.

While the mechanism of action of the activation solution and process of the present invention is unknown at present, it is believed to reside in the formation of a passive layer during the anodic etching step, which layer remains intact in the absence of any strong acid in the activation solution.

Although the invention has been described with reference to certain preferred embodiments thereof, it will be understood that changes and modifications may be made which are within the skill of the art. Accordingly it is intended to be bound only by the appended claims.

EXAMPLE 6

The process of Example 2 may be repeated using additionally 10 g/l of boric acid in the activation solution, a pH of 7 and etching employing alternating current at 2 asi for 2 minutes. A similar excellent adhering deposit will result.

What is claimed is:

1. A method of forming an adherent chromium deposit on a metal substrate comprising the step of:

(a) activating said substrate by electrolytically etching in an activation solution consisting essentially of a substantially neutral solution of an alkali metal sulfate, and (b) electrodepositing chromium on said thus-activated substrate.

2. A method according to claim 1 wherein the pH of said solution is about 5–10.

3. The method according to claim 1 in which said activation solution is characterized by the absence of added sulfuric acid or chromic acid.

4. A method according to claim 1 in which said alkali metal sulfate is sodium sulfate.

5. A method according to claim 1 in which said alkali metal sulfate is potassium sulfate.

6. A method according to claim 1 in which said pH is about 6–8.

7. A method according to claim 1 in which chromium is deposited from a chromium bath containing a halogen releasing compound selected from the group consisting of iodine, bromine and chlorine, or mixtures thereof.

8. A method according to claim 1 in which said substrate is a ferrous metal substrate.

9. A method according to claim 1 in which the activation solution also includes one or more of the following additives: a buffer, an oxidizing salt, an attack metal compound, a complexor, and a surfactant.

10. A method according to claim 1 in which said oxidizing salt is sodium chromate or sodium molybdate, said attack metal compound is sodium chloride or sodium nitrate, and the complexor is sodium citrate or sodium gluconate.

11. A method according to claim 1 which includes one or more of the additional steps; water rinsing after activation and reverse chromium etching.

12. A method according to claim 1 in which the activation step is carried out for about 10 seconds to 10 minutes at a current density of about 0.1 asi to 10 asi at between room temperature and 50° C.

13. A method according to claim 1 in which the substrate is anodically etched.

* * * * *